US005941649A

United States Patent [19]

Hansel et al.

[11] Patent Number: 5,941,649

[45] Date of Patent: Aug. 24, 1999

[54] METHOD FOR FABRICATING A REGISTRATION GUIDE FOR A WIDE-FORMAT PRINTER OR PLOTTER

[75] Inventors: Gregory A. Hansel, Richfield; Bryan L. Hansel, Lakeville; Donald C. Hansel, Burnsville; Jeffrey J. Johnson, Minnetonka, all of Minn.

[73] Assignee: Encoder Science Technologies LLC, Bloomington, Minn.

[21] Appl. No.: 08/946,535

[22] Filed: Oct. 7, 1997

[51] Int. Cl.[6] ..... B41J 29/42

[52] U.S. Cl. ..... 400/703; 400/103; 33/616

[58] Field of Search ..... 400/279, 103, 400/104, 703, 705.4, 705.5, 706, 706.1; 33/614, 616; 101/485, 486; 347/19, 37, 40, 41; 341/13

[56] References Cited

U.S. PATENT DOCUMENTS

| | | | |
|---|---|---|---|
| 5,521,722 | 5/1996 | Colvill et al. | 101/486 |
| 5,563,591 | 10/1996 | Jacobs et al. | 341/13 |
| 5,777,638 | 7/1998 | Salter et al. | 347/12 |
| 5,803,628 | 9/1998 | Donahue | 400/279 |
| 5,805,183 | 9/1998 | Lidke et al. | 347/41 |

*Primary Examiner*—Christopher A. Bennett
*Attorney, Agent, or Firm*—John F. Klos, Esq.; Larkin, Hoffman, Daly & Lindgren, Ltd.

[57] ABSTRACT

A method for fabricating an encoder containing the intended integer number of registration markings (and spaces) per unit distance, over the correct length of that entire encoder. The method is practiced by producing a template having the desired number of registration indices at reasonably exact tolerances—but at widths and spacing less than or greater than intended for the registration markings, and therefore having an overall length less than or greater than that of the encoder—and using the template to project an image onto a substrate at a suitable scaling factor to form the encoder having the correct widths and spacing of the registration markings on that substrate. The template may be a wholly computer-generated and memory-resident virtual image, or may be imprinted upon a tangible intermediate medium and transferred to the substrate using a projection technique. The scaling process may be accomplished using mechanical, optical, or photochemical techniques, as well as combinations thereof.

27 Claims, 1 Drawing Sheet

METHOD FOR FABRICATING A REGISTRATION GUIDE FOR A WIDE-FORMAT PRINTER OR PLOTTER

BACKGROUND OF THE INVENTION

1. Field of the Invention

The present invention relates generally to registration references for the print head of a high resolution laser or ink-jet printer or a plotter, and in particular to a true-dimension optical encoder strip for a wide-format printer or plotter.

2. Description of the Prior Art

Laser and inkjet printers and plotters utilizing a wide variety of technologies are well known to the art. The term "printers" is used herein generically referring to color and monochromatic (black-and-white) laser printers, inkjet printers, and plotters, unless a particular distinction between these types of devices is specifically called for or noted. In general, many printers and plotters operate using substantially similar or interchangeable technology and components, but are utilized in different applications. Those of skill in the art readily appreciate these distinctions or limitations, and the relative advantages or disadvantages of the corresponding technologies.

Many commercial and personal printers have resolutions of 300 dots per inch (dpi) or greater, with 600 dpi and 1200 dpi becoming standard within recent years. Resolutions of greater than 2000 dpi can be achieved on some high end personal printers, and are conventional for professional printers, typesetting machines, and photoduplicating or photolithography machines.

The basic dot resolution of some printers can be further enhanced electronically by altering the size or shape of the individual dots, or interpolating between standard dot placements to achieve a finer spacing. This technique works effectively to smooth printed images and type faces because few printed elements are composed of single dots—or are spaced apart single dot widths—and the position of the terminal dots along a given line of dots each having predetermined width can be shifted linearly along that line relative to the adjacent dots to thereby overlap the adjacent dots and extend the line less than a full dot width. This electronic enhancement relies on filtering the raster elements of an image to determine better smooth line approximations given the available dot width and interpolation capabilities, and physically on the capacity of the device to accurately position the print head at less than dot-width intervals.

It is readily appreciated that such printers require great precision and uniformity in the ability to repeatably position the print head. Variations in this precision result in compression or expansion along individual lines of an image, or in elements which lack clarity or definition at the desired dot resolution. Variations between lines will result in abnormally dithered or skewed portions of images, or other irregularities in print quality or clarity. In many graphic (raster) images for personal or even professional use, these minor variations will not be readily detectable by normal visual inspection in most applications unless a particular screen pattern or color separation is involved which produces a cascade effect and creates visible distortions throughout larger portions of the total image. By comparison, this lack of precision cannot be tolerated for computer-aided design (CAD) applications. In the case of high resolution or enhanced resolution printers for professional applications, precise print head placement is required to achieve the expected dot resolution of the device over the entire width of the image. Because high resolution images in large formats can be very expensive and slow to produce, plotters are more frequently utilized in applications where a large format image is created (often composed of significant "white space"), but exact accuracy is expected in line weights and the spacing between individual lines, the curvature or length of lines, and the density of image elements.

As such, providing an accurate linear reference to uniformly and repeatably determine the registration or placement of a print head is indispensable for printers and plotters. Many such devices rely on encoder strips which ideally have a multiplicity of discrete markings or "ticks" similar to a rule, equally spaced from one another but without corresponding dimensional references such as inches or points relative to the terminal ends of the encoder strip. A sensor such as an optical emitter/detector is mounted on or near the print head or carriage, and produces a digital or analog signal pulse as the sensor passes and detects each marking. A RISC chip counts those signal pulses and calculates the position of the print head relative to one of the terminal ends of the encoder strip, or to the last reference position of the print head. Given the linear speed of the print head as it traverses the encoder strip—which may be predetermined or calculated using the markings counted during an elapsed time interval—the position of the print head between the confronting edges of two markings (or between opposing edges of one marking) may be readily approximated by linear interpolation as a function of time (assuming uniform spacing between the markings, uniform marking widths, and uniform print head speed).

However, in practice the uniformity or precision in the spacing and weight of markings on an encoder strip is very much less than ideal. This is due primarily to limitations in the fabrication processes which result in inaccurate registration references, and secondarily to the inability to control the affect ambient conditions have on the encoder strips when placed in their operating environment.

One known process to fabricate an encoder strip is metal surface etching. This process is limited to producing metal encoder strips (or strips of materials amenable to similar chemical or lithographic etching processes), and produces several drawbacks. Materials may be selected which have dimensional stability along the linear (longitudinal) direction, although materials with higher thermal stability are conventionally more expensive, particularly in lengths suitable for wide-format printers. Obtaining the base material in a form having uniform thickness and suitable surface smoothness is important. Protection against print-head contact is important, since etching produces a non-uniform or rough surface that could be highly detrimental to a print head if contact occurs. However, maintaining a minimal spacing between the print head and the encoder strip to maximize accuracy and responsiveness is also desired.

Encoder strips fabricated from a polymer sheet or film such as Mylar® are also known. The markings on these polymer film encoder strips may be imprinted in a variety of ways, however the ultimate accuracy of the encoder strip is limited by the precision of the imprinting process or apparatus. Very high resolutions for imprinting encoder strips could be achieved using a device such as a laser photoplotter designed for electronic tooling, printed circuit board (PCB) fabrication, or wafer photoetching processes. However, these devices lack sufficient size to imprint encoder strips for wide-format printers, and are expensive. Larger photoplotters such as those used in reprographics lack sufficient resolution (or default to a lower dimensional tolerance) to themselves achieve the desired accuracy in imprinting markings on an encoder strip, and these devices are traditionally used by individuals whose focus is the production of large scale graphic images where minor variations in raster precision is visually undetectable and therefore ignored or discounted.

In addition, a fundamental flaw has long existed in the basic design of many encoder strips used for wide format printers—and particularly to polymer film encoder strips—which makes fabricating an accurate encoder strip far more difficult. This deficiency is more the result of reliance by those of skill in the art on traditional "lines per inch" standards for calculating and controlling image resolution than an inherent defect in manufacturing equipment. **For example, one inch (1") of encoder strip imprinted for 300 dpi basic (physical) resolution would have an alternating pattern of 150 lines and 150 intervening spaces. However, each line and each space would be one three-hundredths of an inch (1/300") in width. Converting this to decimal form, each line (or space) would have a width of 0.00333333. . . inches, wherein the row of threes in the decimal would repeat infinitely. For suitable precision, the encoder strip would need to be imprinted using a device that provided accuracy to six decimal places, whereas most available devices default to only four or less decimal places of accuracy.

The industry has attempted to address this inherent deficiency in several different ways. One method is to use a high resolution imaging device (such as a photoplotter designed for electronic tooling as described above) to generate a master imprinted on glass (or another permanent material), and using a contact photoprinting process to reproduce encoder strips from that master. This is a relatively slow process, and care must be taken to prevent dust or other contaminants from affecting the contact print. The conventional process of contact printing from a master can lead to loss in image quality, which adversely affects the accuracy or precision of the encoder strip. For wide format encoder strips, the equipment for and corresponding complexity of producing the master can increase the ultimate cost of the encoder strips, and it is necessary to produce a unique master for each version of an encoder strip.

Another widespread method is to imprint markings having only thirty-three thousandths of an inch (0.0033") width and spacing, rounded down from the corresponding infinite decimal. The result is 150 lines and 150 spaces which extend along a total distance of 0.99"for each inch of encoder strip—or 99% of the total length of the encoder strip—for a 1% initial error factor overall. The encoder strip is then mounted by stretching the material to its full 100% length and pinning the opposing ends in place.

It will be readily apparent to those skilled in the art that the polymer strip will not stretch uniformly, thus leading to localized distortions in registration. Furthermore, stretching the encoder strip makes it more susceptible to further stretching, distortion, damage, and deterioration. Since the encoder strip is mounted at opposing ends, the intermediate portion of the strip can be displaced and damaged more easily, and will deform or stretch due to its own weight as well as environmental factors such as humidity. This can result in contact between the print head and encoder strip which may damage one or both, or slow the print head due to friction. Some distortion can be corrected electronically by mapping the distortion patterns in the stretched and mounted encoder strip to a calibration table, and then adjusting the print head controller and printed dot pattern based upon that table. This process would require embedded software to perform the mapping and correction functions, and would significantly impede optimal printing rates. Subsequent stretching or distortion of the encoder strip would require periodic calibration.

Alternately, for a printer being used exclusively for raster or graphic images, the encoder strip could be mounted without stretching, resulting in images printed at 99% of their true widthwise dimension. While this may not be noticeable in many applications, it is not suitable for CAD and other precision applications—and renders the output of two dissimilar printers inconsistent with one another—particularly as the printer increases to wide-format images on the order of 45" to 90" in width (where a 1% error equates with a 0.45" to 0.9" differential between spaced elements).

Another method utilized to correct for the inherent limitation in imprinting resolution is to round the line width and spacing upward rather than downward. Using a sixty-seven thousandths inch (0.0067") combined line width and space rounded up from the corresponding infinite decimal, 150 lines and 150 spaces extend along a total distance of 1.005" for each inch of encoder strip—or 1.005% of the total length of the encoder strip—for a 0.5% initial error factor overall. While this error is less relative to rounding down (assuming a combined spacing of 0.0067" can be achieved while maintaining tolerances), the error must either be incorporated into the printed image or corrected in some manner.

One option is to discard a predetermined number of markings and spaces from one of the terminal ends of the encoder strip. For example, in a 46" wide format, the 0.5% rounding error results in an additional 34.5 lines (45"×150 lines/in.×0.005) lines. Thirty-four lines and an additional space can be discarded from one terminal end of the encoder strip. Another option is to imprint less than all of the full markings, or a partial line or space (or both) per unit of distance. For example, imprinting 149.5 markings per inch by reducing the width of one line and one space by one half reduces the error to 0.17% (per unit distance or total error). The effect is to build a small error into each unit distance (i.e., 0.5 line width per inch). In either case, either the total image width or discrete rows in the image (or both) will be distorted or incorrect, and the ability to perform such an adjustment is dependent on the tolerances and capabilities of the imprinting apparatus.

SUMMARY OF THE INVENTION

The method for fabricating an encoder strip of this invention produces an encoder strip containing the intended integer number of registration markings (and spaces) per unit distance, over the correct length of that entire encoder strip, so that the registration guide has greater precision, uniformity, and dimensional accuracy. The method overcomes the inherent limitation that an encoder strip composed of lines and spaces disposed in a conventional lines-per-inch (lpi) pattern results in lines and spaces having widths represented as infinite decimals, or finite decimals beyond the available accuracy of equipment used to manufacture those encoder strips.

Briefly described, the method is practiced by producing a template having the desired number of registration indices at reasonably exact tolerances provided by conventional equipment—but at widths and spacing less than or greater than intended for the registration markings, and therefore having an overall length less than or greater than that of the encoder strip —and using the template to project an image onto a substrate at a suitable scaling factor to form the encoder strip having the correct widths and spacing of the registration markings on that substrate. The template may be a wholly computer-generated and memory-resident virtual image, or may be imprinted upon a tangible intermediate medium and transferred to the substrate using a projection technique. The scaling process may be accomplished using mechanical, optical, or photochemical techniques, as well as combinations thereof.

While the method of fabricating an encoder of this invention is shown for illustrative purposes in reference to a uniform linear encoder strip having a one-dimensional reference axis, it may be readily appreciated that the same method may be employed to fabricate an encoder having a pair of reference axes oriented generally orthogonally to one another or at a preferred acute or obtuse angle, a non-uniform reference axis such as exponential or logarithmic, as well as encoders for arcuate movement such as rotary or shaft encoders or linear displacement sensors which utilize a rotating element.

DETAILED DESCRIPTION OF THE PREFERRED EMBODIMENTS

The encoder this invention and the method of fabricating that encoder are illustrated in FIGS. 1–6 and referenced generally therein by the numeral 10. For purposes of convenience, the encoder 10 and its method of fabrication or manufacture are referred to interchangeably within the specification to the appropriate extent.

For further convenience, the encoder 10 and its method of fabrication or manufacture are illustrated by representative embodiments encompassing a uniform, linear encoder strip 10 having a single or one-dimensional reference axis. It may be readily appreciated by those of ordinary skill in the art from a complete reading of this specification that the same method may be employed to fabricate an encoder 10 having a pair of reference axes oriented generally orthogonally to one another or at a preferred acute or obtuse angle, a non-uniform reference scale such as exponential or logarithmic, as well as encoders 10 for arcuate movement such as rotary or shaft encoders, or linear displacement sensors which utilize a rotating element. In such cases, terms used herein such as "length" or "lpi" must be equated to their corresponding angular or non-linear counterparts, as is readily understood by those conversant in this field of art.

Figure 1:
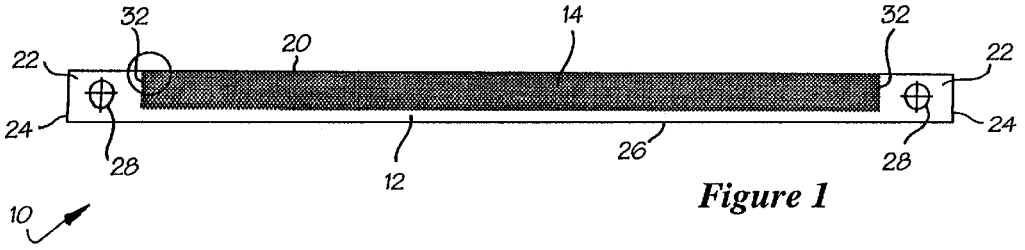
FIG. 1 is a top plan view of an encoder strip embodiment fabricated using the method of this invention.
Figure 2:
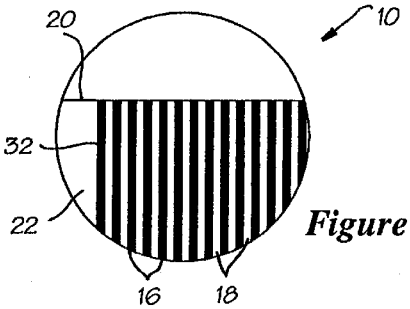
FIG. 2 is a detail view of the portion of the encoder of FIG. 1 shown circled in FIG. 1.
Figure 3:
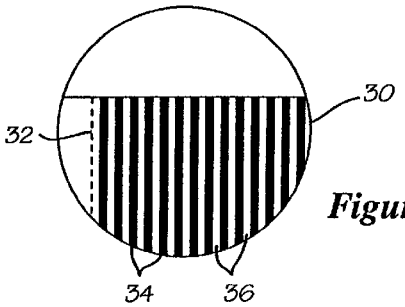
FIG. 3 is a top plan view of a portion of a template used in the method for fabricating the encoder of FIG. 1 corresponding to that portion of the encoder shown in FIG. 2.

Referring particularly to FIGS. 1 and 2, the illustrative encoder strip 10 is shown comprising a substrate material 12 defining a region 14 containing a multiplicity of markings or lines 16 alternating with an equivalent multiplicity of spaces 18. The substrate material 12 is preferably a thin polymeric film such as 7 mil (0.0077±0.0005") light sensitive Mylar® film. The substrate 12 is generally clear or transparent apart from the lines 16—which are black—and is inherently scratch resistant and antistatic, or suitably coated to provide these properties.

The multiplicity of markings or lines 16 are preferably generally parallel with one another and equidistantly spaced along and adjacent one longitudinal edge 20 of the substrate 12, with an open region 22 devoid of lines 16 positioned on each side of the region 14 and disposed proximate to each opposing end edge 24 of the substrate 12. The region 14 of lines 16 preferably traverses only partially across the width of the substrate 12, leaving the opposing longitudinal edge 26 open or devoid of lines 16. It may also be appreciated that only a portion of the region 14 containing the multiplicity of markings or lines 16 may be useable for registration purposes, and that to accommodate existing printer designs the markings or lines 16 may necessarily extend beyond that portion useable for registration or aligned with the printable area.

Registration symbols 28 or markings for properly positioning and aligning the substrate 12 during installation may be imprinted on the substrate 12, those registration symbols being designed or selected as suitable for the particular application, as well as reference indicia such as part number, serial number, fabrication date, revision number, batch or series numbers, surface or orientation identifiers, and so forth. Alternately, the opposing end edges 24 may be cut or trimmed at any orientation or according to any shape at or proximate to the terminal ends 32 of the region 14 of lines 16 and spaces 18.

It may be readily appreciated that the region 14 of lines 16 will appear to an observer without the assistance of visual magnification to be a gray region 14 similar to a halftone, however close inspection will reveal the parallel nature of the lines 16 as opposed to a random, dithered, or stochastic screen pattern associated with a conventional halftone image. The relative degree of shading of the region 14 between transparent (0%) and black (100%) will depend upon the particular width and spacing of the lines 16.

Referring particularly to FIGS. 3–7, the method 10 of fabricating the encoder strip 10 is shown using three representative embodiments, and with reference to an encoder strip 10 in which the substrate 12 is imprinted with a pattern of parallel lines 16 equaling 150 lines-per-inch (lpi). These processes are intended only as illustrative examples which may be readily practiced by those of ordinary skill in the art in light of the teachings contained in this specification, and are in no event intended to limit or constrain the available processes that may be utilized in practicing the invention as described and claimed herein.

In overview, the encoder strip 10 is intended to have an integer number of registration markings or lines 16 per unit linear distance—such as 150 lpi in this example—with these lines 16 separated by the equivalent (n−1) spaces 18 plus an additional space 18 disposed on one of the terminal ends 32 of the region 14 of lines 16. In this exemplary embodiment, the lines 16 and spaces 18 each have a substantially equal width of one three-hundredth of an inch (1/300") which may be expressed as an infinite decimal (0.003333"...). Over the length of the region 14, the total number of lines 16 can be calculated as the length in units of distance times the lines 16 per unit distance. In an encoder strip of 46" width, the total number of lines 16 would be 6750, and twice that for a 90" encoder strip 10. The actual length of the encoder strip 10 would normally be greater than the length of the region 14 of lines 16 by the lengths of the two open regions 22 disposed proximate to each terminal end of the region 14 of lines 16, however for purposes of convenience and clarity of terminology, the length of the encoder strip 10 may be readily interchanged with the length of the region 14 of lines 16. Thus, a 45" encoder strip 10 has a region 14 of lines 16 and spaces 18 extending over a length of 45", while the substrate 12 actually has a length in excess of 45".

The method 10 relies on the use of a template 30 having a multiplicity of indices 34 corresponding to the total number of lines 16 in a predetermined length of the encoder strip 10. That predetermined length may be either the entire length of the encoder strip 10, or some repeatable subset thereof as discussed below. In this example, the indices 34 on the template 30 match the number of lines 16 intended to be on the encoder strip 10 over its entire length.

While the number of the multiplicity of indices 34 and alternating spaces 36 on the template is generally equal to the total number of registration markings or lines 16 and spaces 18 along the length of the encoder strip 10, the indices 34 and spaces 36 do not have the same width as the lines 16 and spaces 18 of the encoder strip 10, and the length of the portion of the template 30 defined by the indices 34 and spaces 36 is therefore different from the length of the corresponding region 14 of the encoder strip 10.

Each indicia 34 and space 36 of the template has a width defined as a non-infinite decimal, representing the width of the corresponding line 16 or space 18 rounded up or down. For example, in the encoder strip 10 having 150 lpi, the template 30 has indices 34 and spaces 36 whose width is each 0.0033±0.0005". As discussed above, this represents a template 30 in which each group of 150 indices 34 and spaces 36 extends only 0.99" rather than one full inch (or 99% of the unit distance). If the width of the corresponding lines 16 and spaces 18 of the encoder strip 10 is rounded down to obtain the width value for the indices 34 and spaces 36 of the template 30, the portion of the template 30 corresponding to the region 14 of the encoder strip 10 will have a length generally less than that of the region 14 of the encoder strip 10. Conversely, if the width of the corresponding lines 16 and spaces 18 of the encoder strip 10 is rounded up to obtain the width value for the indices 34 and spaces 36 of the template 30, the portion of the template 30 corresponding to the region 14 of the encoder strip 10 will have a length generally greater than that of the region 14 of the encoder strip 10.

The template 30 may consist of either a virtual image or a tangible image, as further described herein. A virtual image is intended to connote a computer-generated or memory-resident image or data file (numerical, vector, raster, etc.) which exists predominantly within the electronic domain, and may be fixed or transported via magnetic or optical media or any other suitable memory-storage technology. The virtual image may be either a positive or negative of the image intended to be imprinted upon the substrate 12 to form the encoder strip 10, depending upon the apparatus utilized to project or imprint the image onto the substrate 12. Consequently, the term "virtual" is not intended to imply a positive-negative relationship in the traditional photographic sense—although such a relationship may exist between the template 30 image and substrate 12 image as shown by a comparison of FIGS. 2 and 3—but rather the existence of the template 30 image wholly or partially in the electronic domain.

Figure 4:
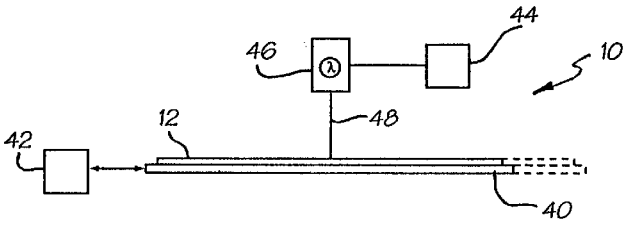
FIG. 4 is a side elevation view diagrammatically showing one embodiment of the apparatus for imprinting the encoder of FIG. 1 utilizing a virtual template and a substrate which moves relative to the image-projecting light source.

Referring particularly to FIG. 4, one process for imprinting the image contained in the virtual template 30 onto the substrate 12 is shown using an image-projecting light source. The image of the virtual template 30 is loaded from media or memory to a central processing unit (CPU) 44 which is operatively connected to an image-projecting light source 46 such as a laser. The CPU 44 may constitute a general purpose microprocessor (GPMC) or reduced instruction set (RISC) chip, or any other conventional processor in combination with other memory, bus, interface, or components suited for this purpose. The image of the template 30 is read by the CPU 44 and utilized to control actuation and trajectory of the coherent, monochromatic light beam 48 emanating from the light source 46 to imprint the image of the encoder strip 10 on the substrate 12. The image on the virtual template 30 is scaled by the appropriate factor using a mechanical apparatus, an electronic or optical system, a photochemical process, or various combinations of these techniques. For example, the substrate 12 may be attached to a platen 40 which is operatively connected to a servo motor 42 for moving the platen 40 longitudinally (i.e., parallel with the direction of extent of the encoder strip 10) at an infinitely variable linear speed within a given range of speeds relative to the stationary light source 46, or conversely the light source 46 maybe operatively connected to the servo motor 42 and moved longitudinally relative to the stationary substrate 12. The appropriate scaling factor represents the ratio of the standard or normal drive speed required to produce an exact 1:1 (or 100%) proportionate linear relationship in the longitudinal direction between the template 30 image and the encoder strip 10 image, and the relative linear speed corresponding to an enlargement (or reduction) equal to the scaling factor. For example, if the normal relative linear speed between the light source 46 and substrate 12 to produce a 100% image were X, then a 99% reduction would be accomplished by providing a relative speed of 0.99(X), and a 101% enlargement would be accomplished by providing a relative speed of 1.01(X). This scaling would be accomplished by driving the servo motor 42 at an actual speed corresponding to the normal speed and the desired scaling factor.

Consequently, in the representative example discussed above, this conventional imprinting equipment capable of tolerances at ±0.0005" have proven suitable to imprint a reduced virtual template 30 of 0.0033" width lines 16 and spaces 18 on the substrate 12 with the applicable scaling factor to achieve an actual enlarged image on the encoder strip 10 at 150 lpi and uniform 1/300" width of lines 16 and spaced 18. One suitable system for imprinting wide-format encoder strips 10 according to this embodiment on a film substrate 12 as discussed above is a wide format laser photoplotter in the red light spectrum having a width up to 96".

In using a film substrate 12 to practice the invention as described above, it will be apparent to those skilled in the art that other parameters in addition to physical displacement must be controlled or can be regulated to accomplish or optimize the scaling action. For example, in any exposure- or emulsion-dependent imprinting system (such as light-sensitive photographic film), the relative exposure and accompanying "blooming" of the image on the substrate 12 during developing will affect the eventual image on the substrate 12 which forms the encoder strip 10. Consequently, exposure and developing parameters must be carefully controlled to maintain predetermined conditions, or may be selectively adjusted and utilized to augment or refine the scaling process. The availability, reliability, uniformity, and effectiveness of such fine-tuning steps will depend on the particular materials and equipment being used, the prevailing environmental conditions, as well as the nature of the intended encoder strip 10 image, and will therefore require some degree of initial estimation or calculation followed by experimentation or trial-and-error to achieve the intended and optimal result.

It may be readily appreciated that other variations of this system and process utilizing a virtual template 30 can be adopted, depending upon the technology employed in the imprinting equipment and the particular encoder strip 10 or template 30. For example, the virtual template 30 may also be displayed or projected in a manner comprising a pseudo-tangible template 30, such as by projecting the electronic domain image of the template 30 as a mask using a tangible apparatus such as a light-transmitting liquid crystal display (LCD) (not shown) disposed between the light source 46 and the substrate 12.

Alternately, a tangible template 30 having a fixed image of the intended encoder strip 10 may be utilized with a corresponding scaling process.

The tangible template 30 may be fabricated or manufactured using any conventional equipment capable of imprinting a light-blocking image on a light-transmitting media at the appropriate resolution and within dictated tolerances without defaulting to a lesser tolerance. It may also be appreciated that since the template 30 is used to fabricate an encoder strip 10 by light exposure, the template 30 will either be a negative or positive of the image to be projected and imprinted on the substrate 12 to form the encoder strip 10, depending upon the exposure properties of that substrate 12. If portions of the substrate 12 exposed to an appropriate wavelength of light expose to black or opaque, then the template 30 will provide a negative image in which the indices 34 on the template 30 corresponding to the lines 16 on the encoder strip 10 will actually be transparent, and the spaces 36 on the template 30 corresponding to spaces 18 on the encoder strip 10 will be opaque.

The template 30 is then used to imprint the lines 16 on the substrate 12 to form the encoder strip 10 by scaling an image of the template 30 onto the substrate 12 at a scaling factor that results in the image of the indices 34 and spaces 36 substantially corresponds to the integer number of registration markings or lines 16 per unit linear distance of the encoder strip 10 and the total number of registration markings or lines 16 within the length of the region 14 of the encoder strip 10. The scaling factor will be an enlargement if the width of the corresponding lines 16 and spaces 18 of the encoder strip 10 were rounded down from the intended width to obtain the width value for the indices 34 and spaces 36 of the template 30, and will be a reduction if the width of the corresponding lines 16 and spaces 18 of the encoder strip 10 were rounded up to obtain the width value for the indices 34 and spaces 36 of the template 30.

Figure 5:
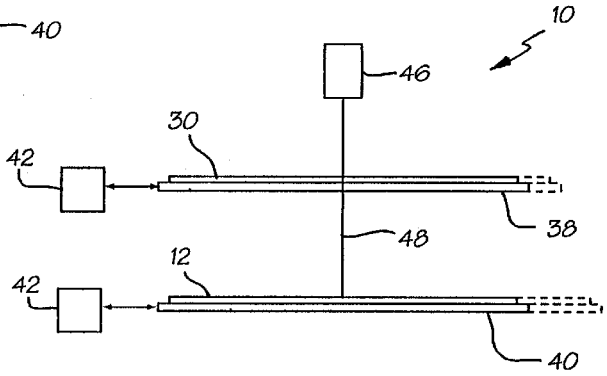
FIG. 5 is a side elevation view diagrammatically showing an alternate embodiment of the apparatus for imprinting the encoder of FIG. 1 utilizing a tangible template and substrate which move relative to one another at differing linear speeds.

Referring to FIG. 5, an embodiment for scaling the image of the tangible template 30 to the intended size of the encoder strip 10 is shown, in which the tangible template 30 is mounted in a holder 38 and the substrate 12 is mounted on a platen 40 so that the template 30 and substrate 12 are oriented in generally parallel alignment with one another. The holder 38 and platen 40 are each operatively connected to a corresponding servo motor 42 or similar mechanism for moving the holder 38 or platen 40 longitudinally, and a laser light source 46 producing a suitable monochromatic beam 48 is oriented such that the beam 48 is oriented generally perpendicular to the planes of both the template 30 and substrate 12. The servo motors 42 are actuated to transport both the template 30 and the substrate 12 past the plane of the beam 48, the template 30 and substrate 12 being driven at different linear speeds corresponding to the scaling factor. In an enlargement, the substrate 12 will move at a speed greater than the speed of the template 30, the ratio of the two linear speeds being determined by the scaling factor. In a reduction, the substrate 12 will move at a speed slower than the speed of the template 30, the ratio of the two linear speeds similarly being determined by the scaling factor.

It may be readily appreciated that other variations of this system can be adopted depending upon the technology employed in the imprinting equipment and the particular encoder strip 10 or template 30. For example, the light source 46 may be moved relative to the template 30 and substrate 12 or both, with only the template 30 or substrate 12 being moved relative to a fixed reference point. Other systems in which the template 30 and substrate 12 are not in longitudinal or parallel alignment with one another—but rather relies on an image projected using reflective or refractive implements—may be suitable for some applications. It is understood that those of ordinary skill may utilize a variety of known or hereafter-developed technologies to accomplish the process of scaling the image of the template 30 such that it corresponds to the intended pattern and spacing of registration markings or lines 16 on the encoder strip 10.

Figure 6:
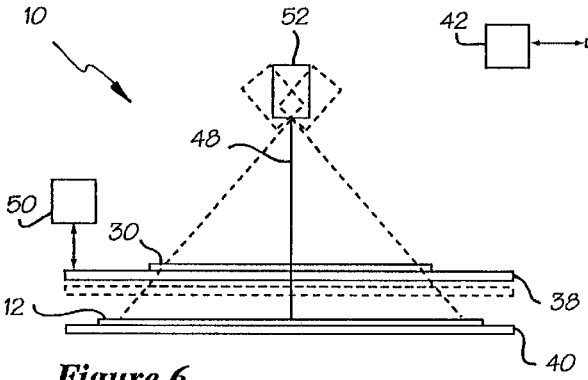
FIG. 6 is a side elevation view diagrammatically showing a further alternate embodiment of the apparatus for imprinting the encoder of FIG. 1 utilizing a diverging projected image of the tangible template onto the substrate.

Referring to FIG. 6, a second embodiment for scaling the image of the template 30 to the intended size of the encoder strip 10 is shown, in which the template 30 is similarly mounted in a holder 38 and the substrate 12 is mounted on a platen 40 so that the template 30 and substrate 12 are oriented in generally parallel alignment with one another. The holder 38 and platen 40 are fixed at predetermined longitudinal positions relative to one another, but the relative spacing between the holder 38 and platen 40 may be selectively varied at fine or discrete increments by one or more servo motors 50 or similar mechanisms for moving the holder 38 or platen 40 transversely. If two such devices 50 are utilized and independently controlled (or one device 50 is utilized and the opposing end of the holder 38 or platen 40 is pivotable), the orientation of the holder 38 relative to the platen 40 may be altered or adjusted. A light source 52 producing a suitable beam 48 is oriented such that the beam 48 is similarly projected towards the template 30 and is thereafter incident on the substrate 12. However, in this embodiment, the light source 52 serves either as a point source which illuminates the entire operative extent of the template 30 and substrate 12 at one instant, or conversely pivots about an axis so that the beam 48 sweeps through an arc extending from one end of the template 30 and substrate 12 to the opposing ends thereof.

It may be appreciated that in such an embodiment, the scaling factor will be an enlargement proportionate to the physical spacing between the template 30 and substrate 12, with the scaling factor being non-uniform through the length of the template 30 and substrate 12 because the angular divergence between the light source 52 and substrate 12 varies from the center to the ends of the substrate 12. In practice, this divergence would be corrected by utilizing a holder 38 and platen 40 which maintain the template 30 and substrate 12 in a curvature whose radius is equal to the distance between the template 30 or substrate 12 and the light source 52. In the case of a scaling factor requiring reduction, this embodiment would necessitate a light source 52 focused on a constant target point, with the light source 52 itself moving to sweep along an arc outside the curvature of the template 30 and substrate 12. Again, it is anticipated that those of ordinary skill in the art may utilize a variety of know or hereafter-developed technologies to accomplish this scaling process, and may utilize systems which incorporate reflective or refractive implements to accomplish the process of scaling the image of the template 30 such that it corresponds to the intended pattern and spacing of registration markings or lines 16 on the encoder strip 10.

The discussion of the above representative embodiments for scaling the image of the template 30 to the intended registration of the encoder strip 10 have been described in terms of discrete encoder strips 10 using diagrammatic representations merely for simplicity. However, in practice a plurality of the encoder strips 10 are fabricated by imprinting a large sheet of film substrate 12 which is subsequently scored into a plurality of individual encoder strips 10. The method 10 may also be practiced using a template 30 having a length which is a subset of the intended length of the corresponding encoder strip 10 which is then offset in a repeatable manner to generate a longer encoder strip 10, however this process would require very accurate alignment and registration between the preceding and succeeding template positions, and is unduly burdensome and time-consuming for fabricating encoder strips 10 of the type used in the exemplary applications as described herein.

Moreover, the above discussion of the scaling factor was directed primarily at the basic mathematical calculations to correct for the inherent deficiency of equipment tolerances by rounding up or down from the intended registration reference and scaling the image of a template 30 having precise number of registration markings. In addition, a variety of other variables or influences may be incorporated into the calculation of the appropriate scaling factor for a particular application. For example, the variation between known environmental factors such as humidity and temperature at the facility where the encoder strip 10 will be imprinted and the facility where it will be installed can be measured and incorporated into the scaling factor, either by simple experimentation or the use of a suitable algorithm.

The encoder strip 10 used as a representative example having 150 lpi and fabricated according to the above method 10 can be manufactured to have multiplicity of registration markings 16 disposed so as to have an integer number of line segments 16 per unit distance reasonably and significantly equal to the predetermined or intended number of registration markings 16 per unit distance, and the predetermined total number of registration markings 16 within the predetermined length of the encoder strip 10, such that the encoder strip 10 provides a substantially uniform registration reference guide without significant distortions or discontinuities throughout the length of the encoder strip 10 and an overall length reasonably and substantially equal to the predetermined length. For example, an encoder strip having a 46.25" intended predetermined length can be fabricated to have 6938 lines 16 and spaces 18, thus achieving 150 lpi within the greater of 0.0005" or 0.06% accuracy throughout the total length of the encoder strip 10 (significantly more accurate and precise than convention registration guides).

It will be readily appreciated that in situations where the encoder strip 10 is fabricated to such tolerances, suitable measures must be taken to preserve the integrity of the encoder strips 10 subsequent to their fabrication. For example, the sheet of many encoder strips 10 is scored or sliced using a roll cutter driven by a servo motor rather than die or blank cutting the encoder strips 10 to prevent any visible delamination or distortion of the edge 20 adjacent the lines 16. The portions of the substrate 12 containing light-sensitive emulsion are coated with a suitable photoguard or stabilizer to prevent scratches or solvent-induced damage. Each encoder strip 10 is individually wrapped in a protective sleeve to protect its surfaces, and heat-sealed in a metal foil package to preserve the humidity and air (or inert gas) quality surrounding the encoder strips 10 during transportation. At the installation facility, the encoder strips 10 are installed on a printer or plotter (not shown) in either a vertical or horizontal orientation using a full contact double-faced tape extending the length of the encoder strip 10 rather than pinning. One double-faced tape 56 which has proven suitable for the purpose of installing or mounting the encoder strips is Scotch® brand High Bond VHB double-faced tape available from the 3M Company of Saint Paul, Minn.

In addition to the steps described above, it is understood that those of skill in the art may need to perform various other optimization or "fine-tuning" measures to the equipment and processes depending upon the particular nature, characteristics, and properties of the selected materials being utilized, the equipment parameters and limitations, and modalities or technology being employed. For example, adjustment of the illumination of the template 30 and exposure of the substrate 12 emulsion may need to be adjusted, as well as the processing technique, to attain or hold the desired dimensional tolerances. These fine-tuning operations will usually require some degree of experimentation or trial-and-error on the part of the technicians, and will vary even between similar systems and environmental conditions.

It may also be appreciated that the uniform pattern of alternating parallel lines 16 and spaces 18 of equal length has been used in this specification as an exemplary embodiment for purposes of clarity and simplicity in understanding the concepts involved, however the method 10 of this invention may be easily adapted and utilized by those of skill in the art to fabricate encoder strips 10 or similar registration guides involving any orientation or pattern of lines 16 and spaces 18, symbols, or other markings that may prove desirable or optimal for a particular intended application.

The representative embodiments described in this specification have utilized a light-sensitive substrate 12 and an image produced by a partially light-transmitting template 30 to achieve the imprinting or exposure process resulting in an encoder strip 10 as described. However, it is understood that the scaling process may also be utilized with other technologies beyond light-sensitive films or substrates 12 and light-transmitting templates 30 and traditional exposure or printing processes. It is contemplated that scaling may be accomplished through a variety of other modalities beyond exposure- or printing-based systems, including other optical, mechanical, electrical, and chemical techniques or computer-performed algorithms.

While the preferred embodiments of the above encoder strip 10 and its method of fabrication or manufacture 10 have been described in detail with reference to the attached drawings Figures, it is understood that various changes, modifications, and adaptations may be made in the encoder strip 10 or method 10 without departing from the spirit and scope of the appended claims, none of which are drafted utilizing means-plus-function or step-plus-function terminology within the meaning of 35 USC §112, ¶6.

What is claimed is:

1. A method for fabricating an encoder for use as a registration reference for the print head of a printer, said encoder having an integer number of registration markings per unit linear distance, a length, and a total number of registration markings within said length, said method comprising the steps of:

providing a template having a multiplicity of indices spaced generally equidistantly therealong, said multiplicity of indices being generally equal to the total number of registration markings in the length of the encoder, said template having a length defined by the extent of said multiplicity of indices, said length of said template being generally less than or generally greater than the length of the encoder;

providing a substrate on which the encoder is to be imprinted;

providing a light source incident on said template and said substrate; and projecting an image of said multiplicity of indices onto said substrate while enlarging or reducing said image by a scaling factor such that said image of said multiplicity of indices on said substrate corresponds to the integer number of registration markings per unit linear distance of the encoder and the total number of registration markings within the length of the encoder.

2. The method of claim 1 wherein the length of the template is less than the length of the encoder, and the image of the multiplicity of indices projected on the substrate is an enlargement having a scaling factor greater than 1.

3. The method of claim 1 wherein the template is a negative image of the multiplicity of indices projected on the substrate to form the registration markings on the encoder.

4. The method of claim 1 wherein substrate is a light-sensitive film.

5. The method of claim 1 wherein the substrate is fabricated from Mylar®.

6. The method of claim 1 wherein the template consists of a virtual image stored in the electronic domain.

7. The method of claim 1 wherein the substrate generally defines a plane, and wherein the light source is a laser producing a beam oriented generally perpendicular to said plane of the substrate.

8. The method of claim 1 wherein the step of projecting the image onto the substrate while enlarging or reducing the image by a scaling factor is accomplished by moving the substrate longitudinally relative to the light source at a linear speed proportional to the scaling factor.

9. The method of claim 1 wherein the multiplicity of registration markings are generally parallel, spaced-apart opaque line segments alternating with generally transparent spaces.

10. The method of claim 1 wherein the encoder is for installation on a wide-format printer or a wide-format plotter.

11. The method of claim 1 wherein a useable registration portion of the encoder has a length of approximately 24" or greater and the overall length is 36" or greater.

12. The method of claim 1 wherein a plurality of individual encoders are fabricated on a sheet of substrate, the method further comprising the step of:

slicing the sheet to form the plurality of individual encoders.

13. The method of claim 1 further comprising the step of:

packaging the encoder in a substantially air-tight, sealed package which maintains the humidity of the air or gas surrounding the encoder within said package during transportation.

14. A method for fabricating an encoder, said encoder having a number of registration markings per unit linear distance, a length, and a total number of registration markings within said length, said method comprising the steps of:

providing a template having a multiplicity of indices spaced therealong, said template having a length defined by the extent of said multiplicity of indices, said length of said template being generally less than or generally greater than the length of the encoder;

providing a substrate on which the encoder is to be imprinted; and projecting said template onto said substrate to form an image of said multiplicity of indices on said substrate while enlarging or reducing said image by a scaling factor such that said image of said multiplicity of indices on said substrate corresponds to the number of registration markings per unit linear distance of the encoder and the total number of registration markings within the length of the encoder.

15. The method of claim 14 wherein the length of the template is less than the length of the encoder, and the image of the multiplicity of indices projected on the substrate is an enlargement having a scaling factor greater than 1.

16. The method of claim 14 wherein the template is a negative image of the multiplicity of indices projected on the substrate to form the registration markings on the encoder.

17. The method of claim 14 wherein substrate is a light-sensitive film.

18. The method of claim 14 wherein the substrate is fabricated from Mylar®.

19. The method of claim 14 further comprising the step of:

providing a light source incident on the substrate which projects the image of the template on the substrate.

20. The method of claim 19 wherein the substrate generally defines a plane, and wherein the light source is a laser producing a beam oriented generally perpendicular to said plane of the substrate.

21. The method of claim 1 wherein the template consists of a virtual image stored in the electronic domain, and wherein the step of projecting the template onto the substrate further comprises the steps of:

providing a central processing unit operatively connected to and capable of controlling the actuation of the light source;

reading the virtual image of the template into said central processing unit; and utilizing said central processing unit to control the actuation of the light source such that the light source projects the virtual image of the template onto the substrate.

22. The method of claim 14 wherein the step of projecting the image onto the substrate while enlarging or reducing the image by a scaling factor is accomplished by moving the substrate longitudinally relative to the light source at a linear speed proportional to the scaling factor.

23. The method of claim 14 wherein the multiplicity of registration markings are generally parallel, equidistantly spaced-apart opaque line segments alternating with generally transparent spaces.

24. The method of claim 14 wherein the encoder is for installation on a wide-format printer or a wide-format plotter.

25. The method of claim 14 wherein the encoder has a length of between approximately 40" and approximately 100".

26. An encoder manufactured using the method recited in claim 1.

27. An encoder manufactured using the method recited in claim 14.

* * * * *